US008542799B1

(12) United States Patent
Rogers et al.

(10) Patent No.: US 8,542,799 B1
(45) Date of Patent: Sep. 24, 2013

(54) ANTI-FRETTING COATING FOR ATTACHMENT JOINT AND METHOD OF MAKING SAME

(75) Inventors: Carey Shawn Rogers, Brookfield, WI (US); Benjamin Eric Frey, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 329 days.

(21) Appl. No.: 13/111,266

(22) Filed: May 19, 2011

(51) Int. Cl.
*H01J 35/00* (2006.01)

(52) U.S. Cl.
USPC ..... 378/125; 378/132

(58) Field of Classification Search
USPC ..... 378/119, 121, 125, 132, 133
See application file for complete search history.

(56) References Cited

U.S. PATENT DOCUMENTS

| | | | |
|---|---|---|---|
| 4,914,684 | A | 4/1990 | Upadhya |
| 5,673,301 | A | 9/1997 | Tekriwal |
| 6,203,895 | B1 | 3/2001 | Berger et al. |
| 6,553,097 | B2 | 4/2003 | Hansen et al. |
| 7,492,870 | B2 | 2/2009 | Peterson, II et al. |
| 7,505,564 | B2 | 3/2009 | Anand et al. |

FOREIGN PATENT DOCUMENTS

| | | | |
|---|---|---|---|
| EP | 1818552 | A1 | 8/2007 |
| JP | 1163948 | A2 | 6/1989 |

*Primary Examiner* — Courtney Thomas
(74) *Attorney, Agent, or Firm* — Ziolkowski Patent Solutions Group, SC

(57) ABSTRACT

An x-ray tube includes a cathode adapted to emit electrons, a bearing assembly comprising a bearing hub, a target assembly positioned to receive the emitted electrons, the assembly having a target hub coupled to the bearing hub at an attachment face, wherein the attachment face comprises a first material compressed against a second material, and a first anti-wear coating attached to one of the first material and the second material and positioned between the first material and the second material.

20 Claims, 6 Drawing Sheets

ANTI-FRETTING COATING FOR ATTACHMENT JOINT AND METHOD OF MAKING SAME

BACKGROUND OF THE INVENTION

Embodiments of the invention relate generally to x-ray tubes and, more particularly, to an anti-fretting coating for an attachment joint and a method of making same.

Computed tomography X-ray imaging systems typically include an x-ray tube, a detector, and a gantry assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector converts the received radiation to electrical signals and then transmits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

A typical x-ray tube includes a cathode that provides a focused high energy electron beam that is accelerated across a cathode-to-anode vacuum gap and produces x-rays upon impact with an active material or target provided. Because of the high temperatures generated when the electron beam strikes the target, typically the target assembly is rotated at high rotational speed for purposes of spreading the heat flux over a larger extended area.

As such, the x-ray tube also includes a rotating system that rotates the target for the purpose of distributing the heat generated at a focal spot on the target. The rotating subsystem is typically rotated by an induction motor having a cylindrical rotor built into an axle that supports a disc-shaped target and an iron stator structure with copper windings that surrounds an elongated neck of the x-ray tube. The rotor of the rotating subsystem assembly is driven by the stator.

The target is attached to a support shaft, which is in turn supported by roller bearings that are typically hard mounted to a base plate. Thus, the target provides a thermal path to the roller bearings that can cause the roller bearings to operate at elevated temperature, compromising the life thereof. In order to minimize or reduce the operating temperature of the bearings, often a thermally resistive material is placed between the target and the bearings. The thermally resistive material, referred to sometimes as a thermal barrier, can be designed having a high thermal resistance to include using a material having a relatively low thermal conductivity, a very thin wall and additional length—all resulting in an increased thermal resistance between the target and the bearing. Thermal resistance can be further increased by introducing a bolted joint between the shaft and the roller bearings, as it is well known that contact resistance in, for instance, a bolted joint can cause a large thermal resistance and temperature drop thereacross in conduction heat transfer. As known in the art, bolted joint strength may be enhanced by designing components such that they have an interference fit, and in some instances bolts may be foregone entirely, leaving joint strength entirely to the interference fit at an interface therebetween. Not only may such designs be intended to increase thermal conductivity, bolted and/or interference joints may be introduced into a design to facilitate assembly of components (such as an anode or target assembly) during fabrication of an x-ray tube.

However, because the target is typically rotated about its axis at a high rate of speed, typically 100 Hz or more, and because the x-ray tube itself is rotated at a high rate of speed on a gantry, typically 2 Hz or more, enormous periodic loads can be generated at interfaces that join the target and other rotating components. So, high-frequency periodic loads are applied to the joint due to the target rotation and some unavoidable residual unbalance of the rotating components and low-frequency periodic loads due to the tube rotation on the CT gantry. Such loads in a bolted joint can cause bending of the joints components causing small relative motion to occur, which can cause fretting, leading to particulate generation within the x-ray tube. Fretting and particulate generation can occur in bolted joints and at interfaces that include, for instance, interference joints. In fact, particles can be generated at any interface where materials are such as in a bolted joint or an interference fit pressed together (but not fused or otherwise bonded together, such as in a welded or brazed joint, as examples). And, the effect can increase significantly with increased gantry and/or increased target rotating speed, leading to increased fretting and particulate generation as x-ray tubes are rotated faster on gantries and as targets are rotated faster within x-ray tubes.

As known in the art, particulate in an x-ray tube can degrade performance and life in a number of ways that include, for instance, accelerated bearing wear if the wear particles fall into the bearing and electrical discharge activity in the high voltage environment of the x-ray tube. Both of these issues reduce the useful life of the x-ray tube.

Accordingly, it would be advantageous to have an x-ray tube that could be rotated at a high speed on a gantry and at a high target rotational speed without a reduction in life due to particulate generation at connection joints in the x-ray tube.

BRIEF DESCRIPTION OF THE INVENTION

Embodiments of the invention provide an apparatus and method of attaching a target to a bearing having a reduced amount of particulate generation at interfaces of attachment locations thereof.

According to one aspect of the invention, an x-ray tube includes a cathode adapted to emit electrons, a bearing assembly comprising a bearing hub, a target assembly positioned to receive the emitted electrons, the assembly having a target hub coupled to the bearing hub at an attachment face, wherein the attachment face comprises a first material compressed against a second material, and a first anti-wear coating attached to one of the first material and the second material and positioned between the first material and the second material.

In accordance with another aspect of the invention, a method of fabricating an anode assembly for an x-ray tube includes applying a first anti-wear coating to one of a first material and a second material, and coupling an x-ray target to a bearing at an interface that is comprised of the first material and the second material.

Yet another aspect of the invention includes an x-ray imaging system that includes a gantry, a detector attached to the gantry, and an x-ray tube attached to the gantry. The x-ray tube includes a bearing having a bearing hub, a target having a target hub coupled to the bearing hub at a contact location, and a first anti-fretting coating. The contact location includes a first material attached to a second material, and the first anti-fretting coating is attached to one of the first material and the second material at the contact location and is positioned between the first material and the second material.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION

Figure 1:
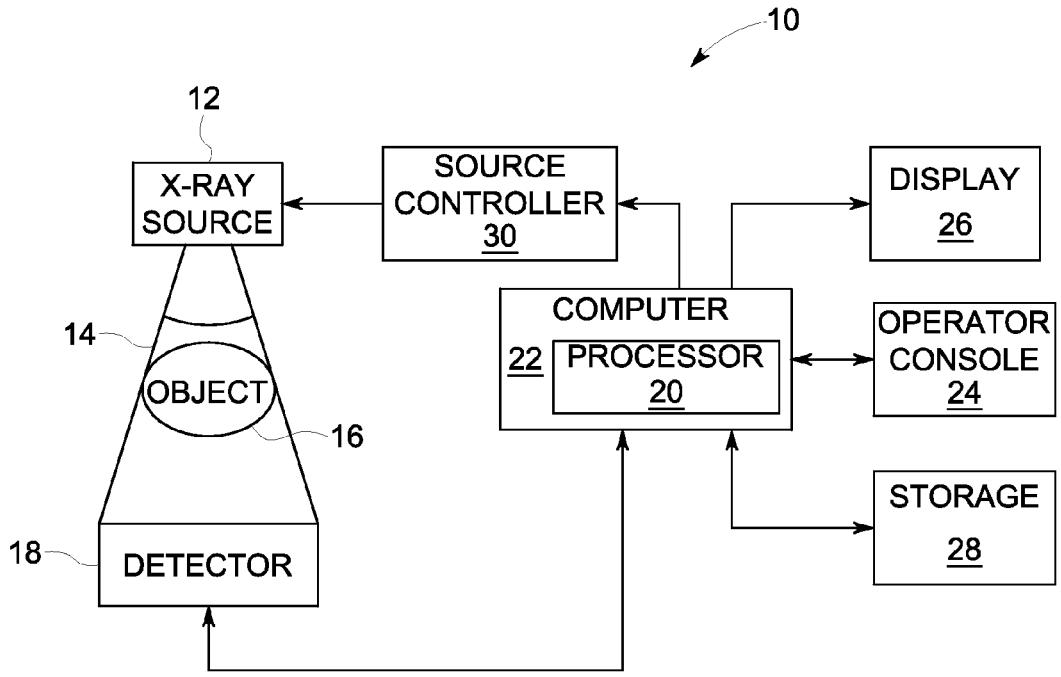
FIG. 1 is a block diagram of an imaging system that can benefit from incorporation of an embodiment of the invention.

FIG. 1 is a block diagram of an embodiment of an imaging system 10 designed both to acquire original image data and to process the image data for display and/or analysis in accordance with the invention. It will be appreciated by those skilled in the art that the invention is applicable to numerous medical imaging systems implementing an x-ray tube, such as x-ray or mammography systems. Other imaging systems such as computed tomography (CT) systems and digital radiography (RAD) systems also benefit from the invention. In a CT system, for instance, x-ray source 12 and detector 18 may be mounted on a gantry (not shown) and rotated about object 16 at a high rate of speed or, for instance, 2 Hz or greater. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, flash memory, compact discs, etc. The operator may also use console 24 to provide commands and instructions to computer 22 for controlling a source controller 30 that provides power and timing signals to x-ray source 12.

Figure 2:
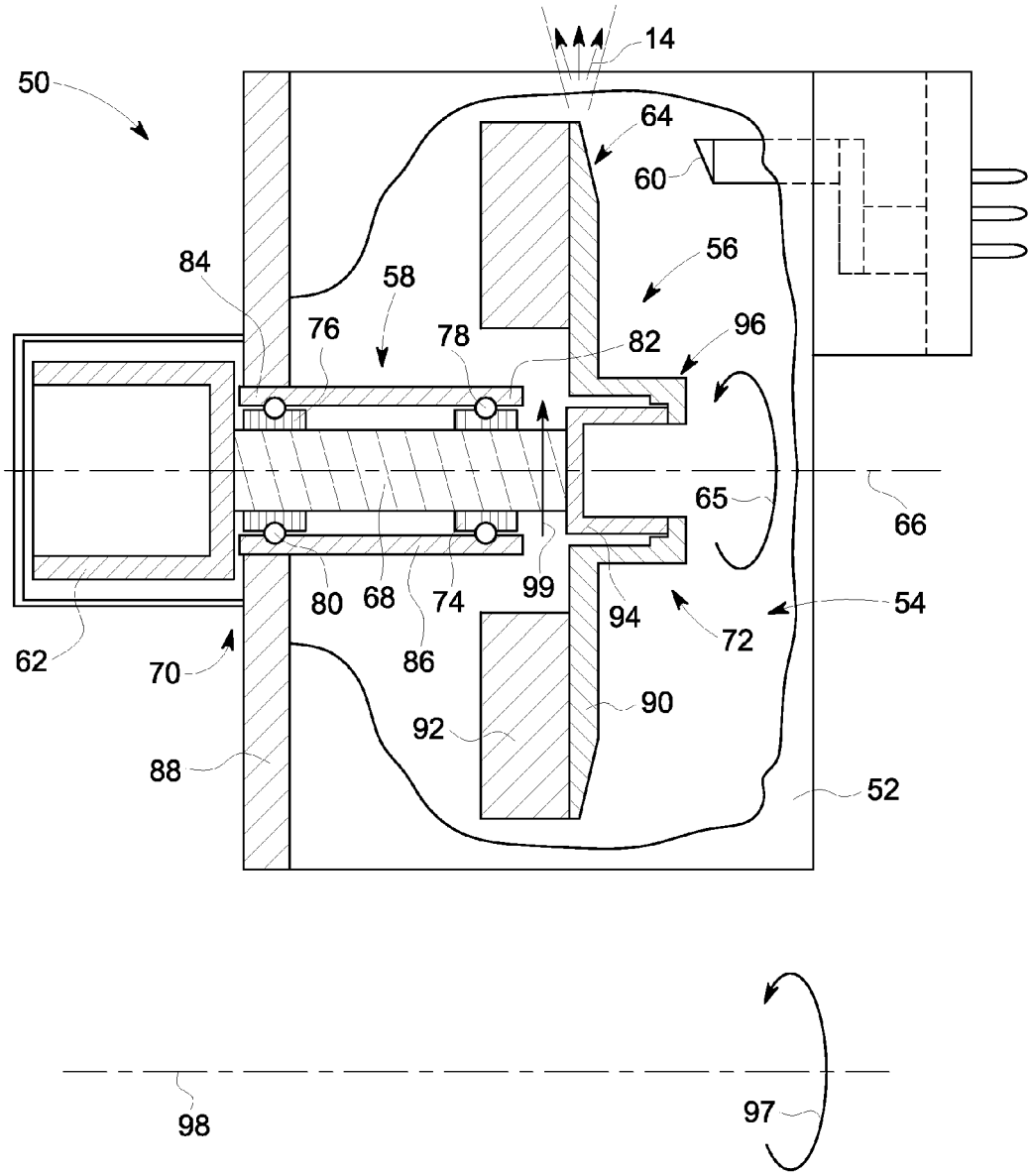
FIG. 2 is a cutaway view of an x-ray tube or source incorporating embodiments of the invention.

FIG. 2 illustrates a cutaway portion of an x-ray source or tube 50 constructed in accordance with the invention. X-ray source or tube 50 may be used in any system using x-rays for imaging, and in one example is x-ray source 12 of FIG. 1. X-ray tube 50 includes a frame or casing 52 that encloses a vacuum 54 and houses an anode assembly 56, a bearing assembly 58, a cathode 60, and a rotor 62. X-rays 14 are produced when high-speed electrons are suddenly decelerated when directed from cathode 60 to anode assembly 56, and particularly to a focal spot 64 via a potential difference therebetween of, for example, 60 thousand volts or more. The electrons impact focal spot 64 and x-rays 14 emit therefrom toward a detector, such as detector 18 illustrated in FIG. 1. To avoid overheating anode 56 from the electrons, anode 56 is rotated 65 at a high rate of speed about a centerline 66 at, for example, 90-250 Hz.

Bearing assembly 58 includes a center shaft 68 attached to rotor 62 at a first end 70 and attached to anode assembly 56 at a second end 72. A front inner race 74 and a rear inner race 76 rollingly engage a plurality of front balls 78 and a plurality of rear balls 80, respectively. Bearing assembly 58 also includes a front outer race 82 and a rear outer race 84 configured to rollingly engage and position, respectively, the plurality of front balls 78 and the plurality of rear balls 80. Bearing assembly 58 includes a stem 86 which is supported by a backplate 88 of x-ray tube 50. A stator (not shown) is positioned radially external to and drives rotor 62, which rotationally drives anode assembly 56.

Anode assembly 56 includes a target 90 having a heat sink material 92 such as graphite attached thereto. Target 90 is attached to a bearing hub 94 at an attachment location or contact region 96 via a number of means that are illustrated in subsequent embodiments of FIGS. 3-5. As known in the art, x-ray tube 50 may be positioned on a gantry (not shown) and caused to rotate 97 about a gantry rotational axis 98. Thus in operation, still referring to FIG. 2, at least two factors can combine to cause relative part motion and fretting in an x-ray tube. First, as anode 56 is caused to rotate about centerline 66 at a high rate of speed, such as 100 Hz or greater, a high frequency input is thus imparted on components at, for instance, contact region 96. Second, by rotating 97 x-ray tube 50 about gantry rotational axis 98 at typically 2 Hz or greater, a bending moment 99 is imposed on components of anode 56 and specifically on contact region 96. As such, relative motion occurs at attachment location or contact region 96 due to the high frequency input of 100 Hz or more, which is exacerbated when compounded with the low frequency component of 2 Hz or greater that is caused by moment 99. As such, as gantry rotational speeds increase above 2 Hz, the effect of wear and fretting of components is compounded, leading to early life failure.

Figure 3:
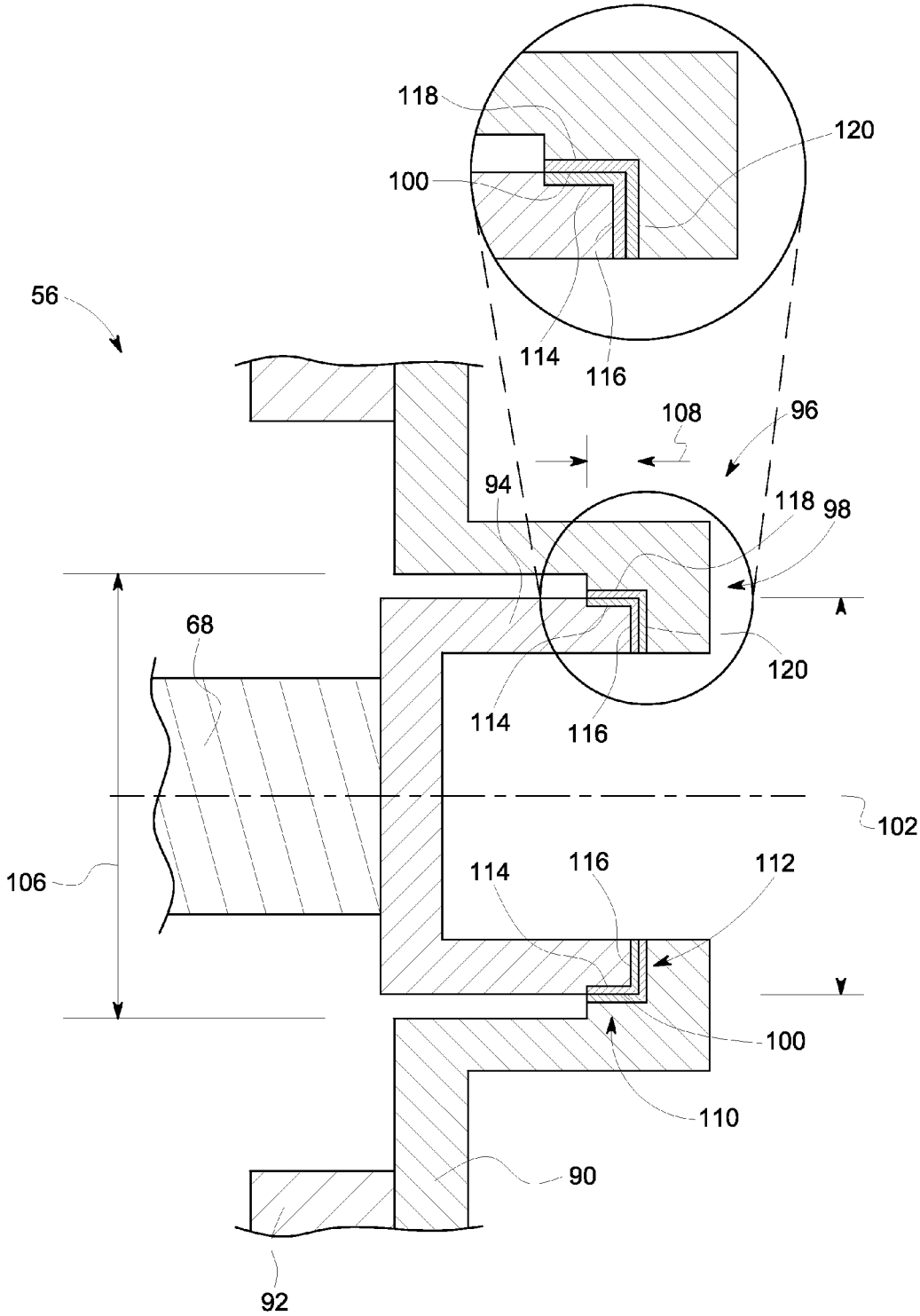
FIG. 3 is an illustration of an interference fit joint, according to an embodiment of the invention.

Referring now to FIG. 3, an enlarged view of attachment location 96 of x-ray source or tube 50 of FIG. 2 is illustrated. Attachment location 96 includes center shaft 68 having bearing hub 94 inserted into an interference-fit region 98 of anode assembly 56 and target 90. Interference-fit region 98 includes an inner surface 100 of attachment location 96 having an interference-fit diameter 102 that corresponds to a hub diameter 104. As known in the art, an interference fit between mating components may be formed by designing components such that they interfere at operating temperature. That is, through appropriate analysis, knowledge of material properties such as material expansion coefficients, and knowledge of for instance temperatures of components during operation, parts fabricated at or near room temperature may be sized appropriately such that an interference fit is formed between components at elevated temperature and during operation.

Referring still to FIG. 3, bearing hub 94 is inserted into interference-fit region 98 such that bearing hub 94 and target 90 are essentially locked together and rotate together during operation. As known in the art, the interference fit may be formed by, for instance, inserting bearing hub 94 into interference-fit region 98 using a lever to force the components together (i.e., a press-fit). In another example, the interference fit may be formed by heating interference-fit region 98 of target 90 to excess temperature such that interference-fit diameter 102 expands to be greater than hub diameter 104 of bearing hub 94. That is, target 90 may be heated to excess temperature above, for instance, 300° C. or more, such that bearing hub 94 may fit therein without interference. As target 90 cools, interference-fit region 98 contracts and forms an interference fit with bearing hub 94. In one example an expanded diameter 106 of target 90 may be included such that an axial interference contact length 108 is formed that is sufficient to maintain component integrity, facilitating insertion of bearing hub 94 into interference-fit region 98. Thus, one skilled in the art will recognize that using appropriate and known techniques, axial interference contact length 108 may be formed such that sufficient interference is maintained during operation when both bearing hub 94 and interference-fit region 98 are at operating temperatures.

As stated, due to enormous loads during operation from high frequency-induced relative motion that is compounded by low frequency input from rotation about the gantry, fretting and relative motion of components may cause particulate to generate at a first interference location 110 such as where outer diameter of bearing hub 94 contacts target 90, and/or at a second location 112 such as along an axial surface where bearing hub 94 contacts target 90. Thus, according to the invention an anti-wear or anti-fretting coating may be applied to bearing hub 94 at a first hub location as a first hub coating 114, or a second hub location as a second hub coating 116. Similarly, an anti-wear or anti-fretting coating may be applied to target 90 at a first target location as a first target anti-wear or anti-fretting coating 118 or a second target location as a second anti-wear or anti-fretting target coating 120. According to the invention, coatings 114-120 may be chromium nitride, titanium nitride, diamond-like carbon, tungsten carbide, tungsten carbon-carbon (WC/C), TiCN, TiAlN, AlTiN, and ZrN, as examples. Further, although a number of examples are provided, it is contemplated that the invention is not to be so limited. According to the invention, coatings 114-120 may include any material for a coating that reduces fretting, wear of components, and ultimately particulate generation for rotating components in a vacuum, such as in an x-ray tube, that have counterfaces pressed or otherwise maintained against each other. In one example coatings 114-120 include materials having a hardness of 1750 measured on the Vickers HV scale.

Coatings 114-120 reduce wear and fretting via one or more processes. Firstly, the coating is harder than the base material to which it is adhered, so its wear rate (adhesive and abrasive wear rate) is lower than the base material. Secondly, in a vacuum its coefficient of friction can be lower than the base material system thereby lower friction wear action. Also, the metallurgical affinity between the counterface materials is much less by using dissimilar materials. These factors all combine to reduce the rate of particulate production in high temperature and high vacuum environments, such as experienced in an x-ray tube, of up to approximately 600° C. in a vacuum of 1E-6 torr. Thus, particulate generation can be reduced by using preferably different coatings on each mating surface (e.g., CrN-WC). In another example coatings 114-120 are applied having a thickness of approximately 2-5 microns (although coatings such as coatings 114-120 for this and other embodiments are shown having thicknesses greater than 2-5 microns for illustrative purposes). Further, it is contemplated that any coating thickness may be applied for coatings 114-120 and other coatings described herein, and that the invention is not limited to coating thicknesses of 2-5 microns, but may have greater or lesser thicknesses than 2-5 microns.

According to the invention, coatings 114-120 may be applied using physical vapor deposition (PVD) (such as but not limited to sputtering and ion plating, as examples) and other known techniques for applying a smooth and uniform application of material. Further, embodiments of the invention include having coatings applied to each part such that a first coating is pressed against a second coating. For instance, in one embodiment coating 114 may be applied to bearing hub 94 and coating 118 may be applied to target 90 at attachment location 96 such that coating 114 is pressed against coating 118 when the interference fit is formed. In this embodiment, coatings 114 and 118 are preferably of different materials. That is, as one example coating 114 may be chromium nitride and coating 118 may be titanium nitride. In another example, coating 118 is diamond-like carbon and bearing hub 94 is uncoated (i.e., coating 114 is not present). As such, embodiments of the invention include a first material pressed against a second material, and the opposing materials are preferably of different materials. Thus, because of the different materials, friction therebetween the two is minimized and there is a reduced amount of adhesive wear because an amount of diffusion bonding between the materials is reduced, as compared to an interface of two of the same materials pressed against each other.

Figure 4:
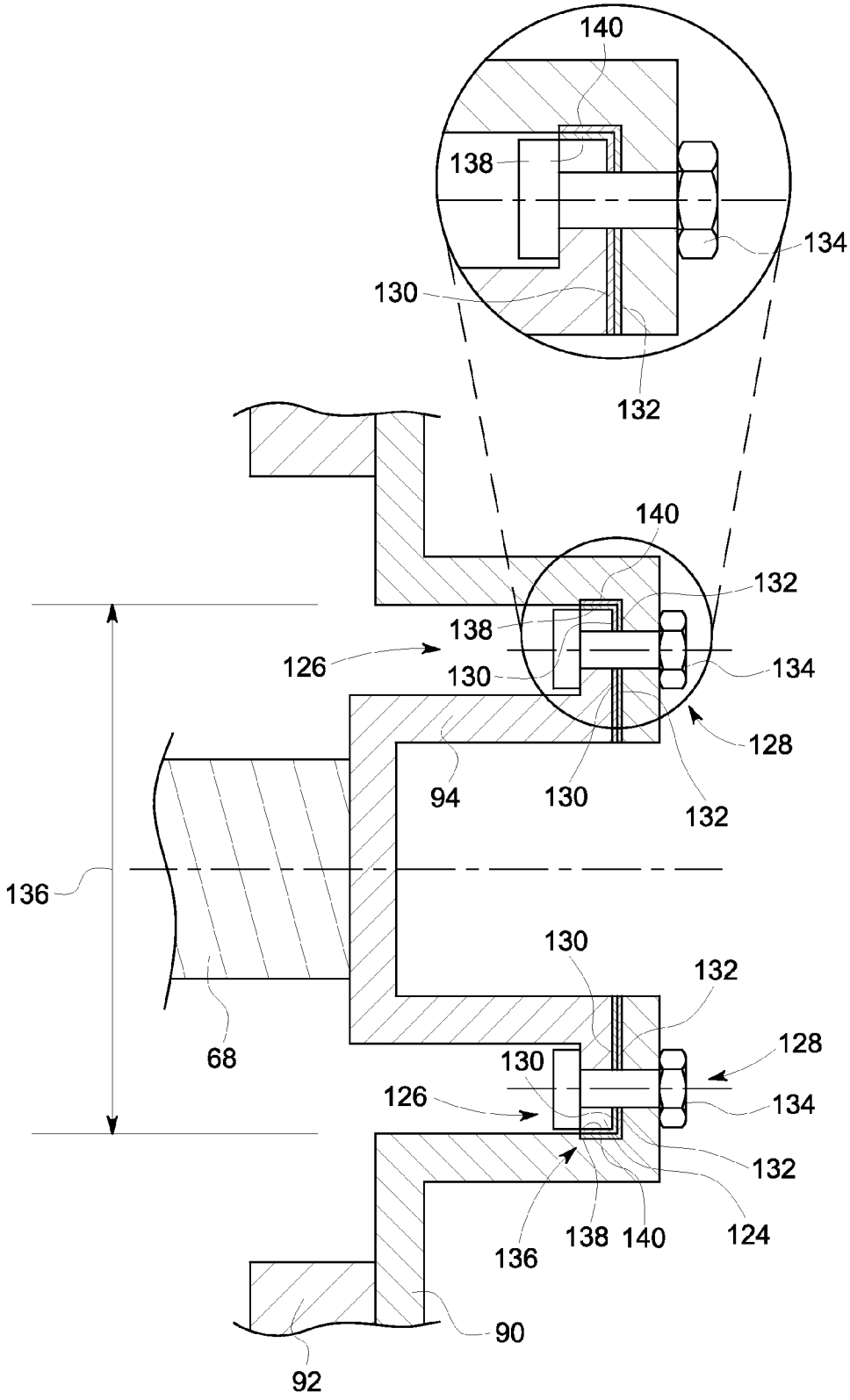
FIG. 4 is an illustration of a bolted joint, according to an embodiment of the invention.

As stated, FIG. 3 illustrates an interference fit between a bearing hub and a target that may be assembled using known techniques such as a press fit or an interference fit that is formed by heating the target to cause expansion of the target such that the bearing hub may be positioned therein. However, according to the invention the target may be attached to the bearing hub using other known techniques. For instance, FIG. 4 illustrates a bolted joint that may also include an interference fit, for additional joint stability, similar to that illustrated in FIG. 3. In yet another embodiment of the invention, illustrated in FIG. 5, a thermal barrier may be provided that includes at least two bolted joint regions and may include interference fits of components, as well.

Referring now to FIG. 4, a bolted joint 122 may be used to directly attach target 90 to bearing hub 94. In this embodiment bearing hub 94 includes a flange 124 having flange holes 126, and target 90 having target holes 128 that match with locations of flange holes 126 such that target 90 may be bolted to bearing hub 94. According to the invention a flange face coating 130 may be applied to flange 124, or a target wear coating 132 may be applied to target 90. In such fashion, when target 90 is attached to bearing hub 94 via bolts 134, coatings 130 or 132 applied as illustrated at one or the other location reduces an amount of fretting and particulate generation by having a low coefficient of friction therebetween, and materials that are not chemically compatible so as to avoid diffusion bonding.

Still referring to FIG. 4, bolted joint 122 may include an interference fit between flange 124 and target 90 at flange outer diameter 136, in order to enhance the strength of bolted joint 122. Thus, similar to that described with respect to FIG. 3, in an embodiment that includes an interference fit, additional coatings may be applied as a flange outer diameter coating 138 and an interference fit inner diameter coating 140

Figure 5:
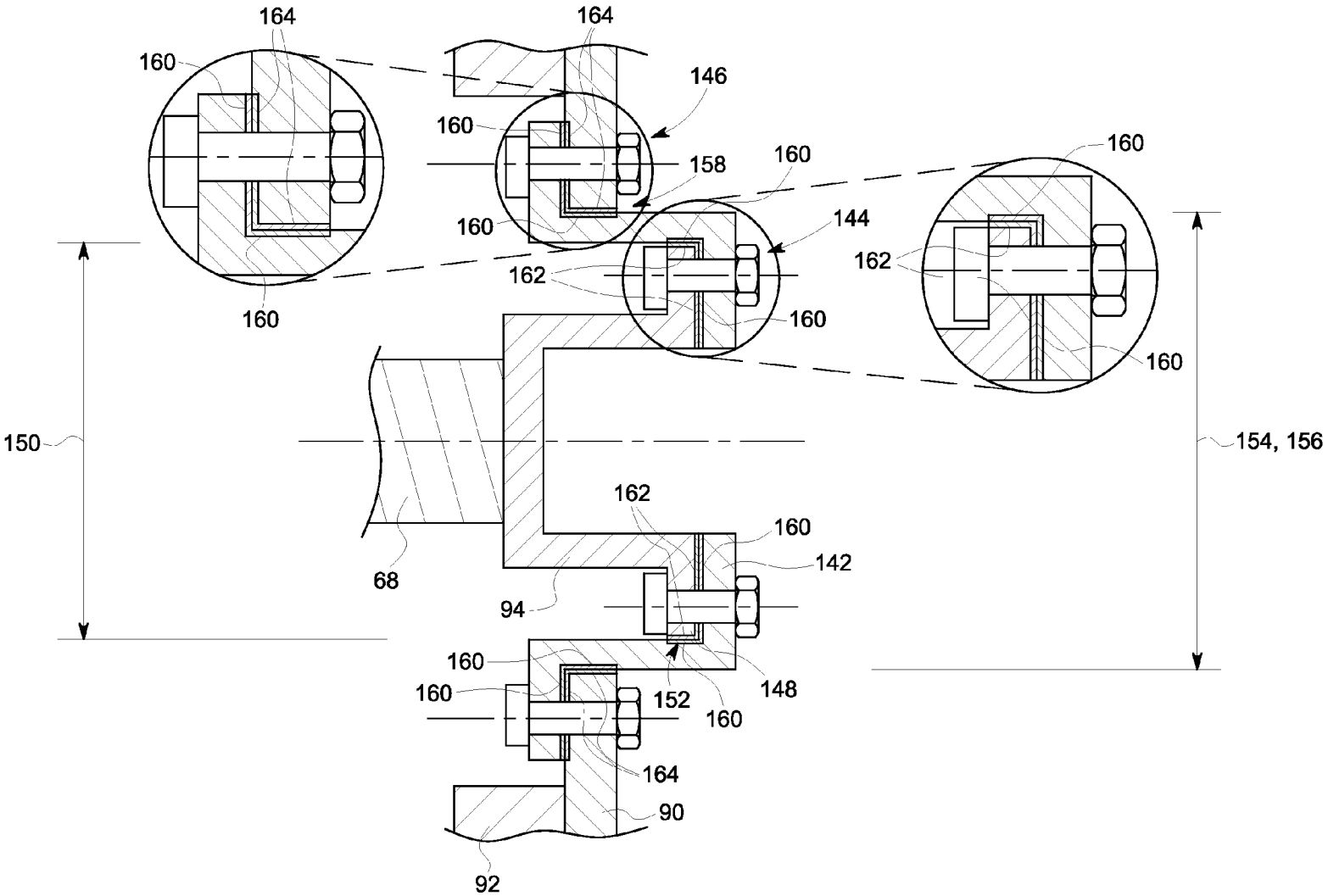
FIG. 5 is a joint including a thermal barrier, according to an embodiment of the invention.

Referring now to FIG. 5, a thermal barrier 142 is used to attach target 90 to bearing hub 94 via a first bolted joint 144 and a second bolted joint 146. In one example thermal barrier 142 is Incoloy 909® (Incoloy is a registered trademark of Inco Alloys International, Inc. of Delaware), selected for its relatively low thermal conductivity (compared to, for instance, a bearing hub) and stability for machining and during operation, as examples. According to one embodiment, bolted joints 144, 146 are sufficient to provide attachment of bearing hub 94 to target 90. However, in another embodiment additional joint strength may be provided between a bearing flange 148 and an inner diameter 150 of thermal barrier 142 by providing a first interference fit 152 as described above with respect to other embodiments. Similarly, additional joint strength may be provided between an outer diameter 154 of thermal barrier 142 and an inner diameter 156 of target 90 to form a second interference fit 158. Thus, a material 160 may be applied to thermal barrier 142, a material 162 may be applied to bearing hub 94, and a material 164 may be applied to target 90, as described above with respect to other embodiments of the invention, such that dissimilar materials are applied at contact locations formed by the two bolted joints 144, 146.

Thus, according to the embodiments illustrated, a target may be attached to a bearing hub by using interference fits, bolted joints, or combinations thereof. Further, such attachment may also be accomplished using a thermal barrier and bolted joints, interference fits, or combinations thereof. In locations where contact points or surfaces are formed, anti-wear or anti-fretting coatings may be applied to one contact surface, the other contact surface, or both. As such, embodiments of the invention include a first material pressed against a second material, and the opposing materials are preferably of different materials. Thus, because of the different materials, friction therebetween the two is minimized and there is a reduced amount of adhesive wear because an amount of diffusion bonding between the materials is reduced, as compared to two of the same materials pressed against each other.

Further, although the embodiments described are for an x-ray tube application and for a joint attaching an x-ray tube target to a bearing hub, it is to be understood that the invention is not to be so limited, and it is contemplated that the invention may be applicable to any rotating components where fretting may occur, causing particulate generation.

Figure 6:
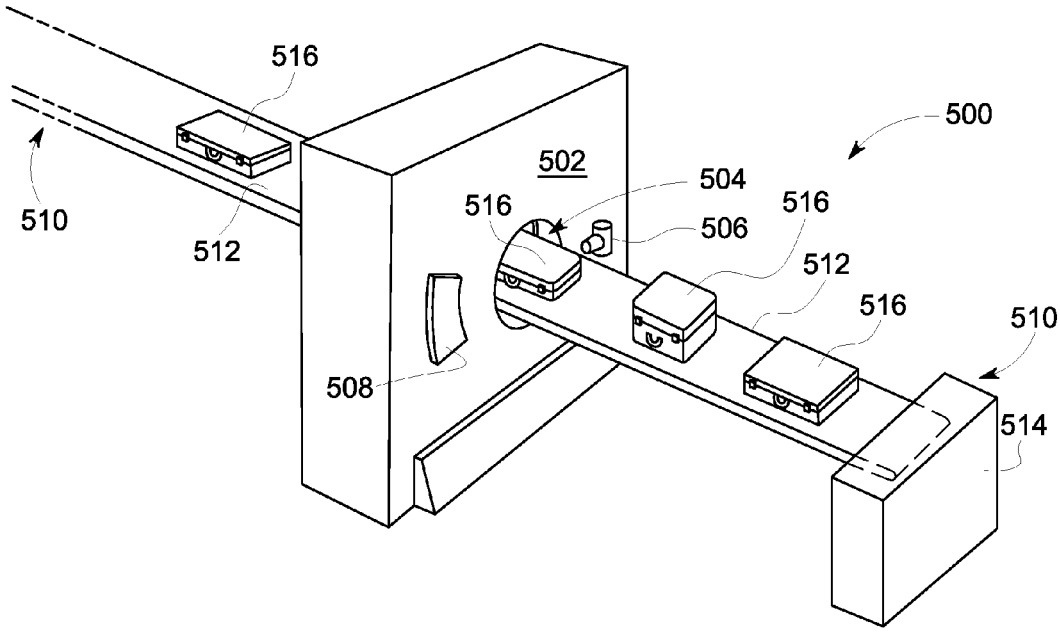
FIG. 6 is a pictorial view of a CT system for use with a non-invasive package inspection system.

FIG. 6 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

According to an embodiment of the invention, an x-ray tube includes a cathode adapted to emit electrons, a bearing assembly comprising a bearing hub, a target assembly positioned to receive the emitted electrons, the assembly having a target hub coupled to the bearing hub at an attachment face, wherein the attachment face comprises a first material compressed against a second material, and a first anti-wear coating attached to one of the first material and the second material and positioned between the first material and the second material.

According to another embodiment of the invention, a method of fabricating an anode assembly for an x-ray tube includes applying a first anti-wear coating to one of a first material and a second material, and coupling an x-ray target to a bearing at an interface that is comprised of the first material and the second material.

Yet another embodiment of the invention includes an x-ray imaging system that includes a gantry, a detector attached to the gantry, and an x-ray tube attached to the gantry. The x-ray tube includes a bearing having a bearing hub, a target having a target hub coupled to the bearing hub at a contact location, and a first anti-fretting coating. The contact location includes a first material attached to a second material, and the first anti-fretting coating is attached to one of the first material and the second material at the contact location and is positioned between the first material and the second material.

The invention has been described in terms of the preferred embodiment, and it is recognized that equivalents, alternatives, and modifications, aside from those expressly stated, are possible and within the scope of the appending claims.

What is claimed is:

1. An x-ray tube comprising:

a cathode adapted to emit electrons;

a bearing assembly comprising a bearing hub;

a target assembly positioned to receive the emitted electrons, the assembly having a target hub coupled to the bearing hub at an attachment face, wherein the attachment face comprises a first material compressed against a second material; and a first anti-wear coating attached to one of the first material and the second material and positioned between the first material and the second material.

2. The x-ray tube of claim 1 wherein the first anti-wear coating is one of chromium nitride, titanium nitride, diamond-like carbon, tungsten carbide, WC/C, TiCN, TiAlN, AlTiN, and ZrN.

3. The x-ray tube of claim 1 wherein the target hub is coupled to the bearing hub via one of a bolted joint and an interference fit joint.

4. The x-ray tube of claim 3 comprising a thermal barrier wherein:

the bearing hub is attached to the thermal barrier at a first attachment location;

the target hub is attached to the thermal barrier at a second attachment location;

the first material is comprised of the thermal barrier;

the second material is comprised of one of the target hub and the bearing hub; and the attachment face is at one of the first attachment location and the second attachment location.

5. The x-ray tube of claim 3 wherein the target hub comprises the first material and is compressed against the bearing hub, and wherein the bearing hub comprises the second material.

6. The x-ray tube of claim 1 comprising a second anti-wear coating, different from the first anti-wear coating, positioned on the other of the first material and the second material.

7. The x-ray tube of claim 6 wherein the second anti-wear coating is one of chromium nitride, titanium nitride, diamond-like carbon, and tungsten carbide, WC/C, TiCN, TiAlN, AlTiN, and ZrN.

8. A method of fabricating an anode assembly for an x-ray tube comprising:

applying a first anti-wear coating to one of a first material and a second material; and coupling an x-ray target to a bearing at an interface that is comprised of the first material and the second material.

9. The method of claim 8 comprising coupling the x-ray target to the bearing assembly via one of a bolted joint and a shrink fit joint.

10. The method of claim 8 comprising coupling the x-ray target to the bearing assembly via a thermal barrier, wherein the first material is the thermal barrier and the second material is one of a hub of the bearing and a hub of the target.

11. The method of claim 8 comprising coupling a hub of the x-ray target directly to a hub of the bearing, wherein the hub of the x-ray target comprises the first material and the hub of the bearing comprises the second material.

12. The method of claim 8 comprising applying the first anti-wear coating to another of the first material and the second material.

13. The method of claim 8 comprising applying a second anti-wear coating to the other of the first material and the second material.

14. The method of claim 13 wherein the second anti-wear coating is different from the first anti-wear coating.

15. An x-ray imaging system comprising:

a gantry;

a detector attached to the gantry; and an x-ray tube attached to the gantry, the x-ray tube comprising:

a bearing having a bearing hub;

a target having a target hub coupled to the bearing hub at a contact location; and a first anti-fretting coating;

wherein the contact location comprises a first material attached to a second material, and wherein the first anti-fretting coating is attached to one of the first material and the second material at the contact location and is positioned between the first material and the second material.

16. The x-ray imaging system of claim 15 wherein the first anti-fretting coating is one of chromium nitride, titanium nitride, diamond-like carbon, and tungsten carbide, WC/C, TiCN, TiAlN, AlTiN, and ZrN.

17. The x-ray imaging system of claim 15 wherein the bearing hub is attached directly to the target hub at the contact location, and wherein the bearing hub is the first material and the target hub is the second material.

18. The x-ray imaging system of claim 15 comprising a thermal barrier, wherein:

the bearing hub is attached to the thermal barrier at a first attachment location;

the target hub is attached to the thermal barrier at a second attachment location;

the first material is comprised of the thermal barrier;

the second material is comprised of one of the target hub and the bearing hub; and the contact location is one of the first attachment location and the second attachment location.

19. The x-ray imaging system of claim 15 comprising a second anti-fretting coating attached to the other of the first material and the second material, wherein the second anti-fretting material is a material that is different from the first anti-fretting material.

20. The x-ray imaging system of claim 19 wherein the first anti-fretting coating and the second anti-fretting coating are comprised of one of chromium nitride, titanium nitride, diamond-like carbon, tungsten carbide, WC/C, TiCN, TiAlN, AlTiN, and ZrN.

* * * * *